US006006950A

United States Patent [19]

Watanabe et al.

[11] Patent Number: 6,006,950

[45] Date of Patent: Dec. 28, 1999

[54] PUMP DISPENSER WITH ROTATABLE NOZZLE TRIGGER LOCK

[75] Inventors: Noritoshi Watanabe; Katsuhito Kuwahara; Yoshiyuki Kakuta, all of Koto-Ku, Japan

[73] Assignees: Yoshino Kogyosho Co., Ltd.; Kao Corporation, both of Tokyo, Japan

[21] Appl. No.: 09/077,970

[22] PCT Filed: Oct. 22, 1997

[86] PCT No.: PCT/JP97/03817

§ 371 Date: Jun. 15, 1998

§ 102(e) Date: Jun. 15, 1998

[87] PCT Pub. No.: WO98/17399

PCT Pub. Date: Apr. 30, 1998

[30] Foreign Application Priority Data

Oct. 22, 1996 [JP] Japan ..... 8-299420

[51] Int. Cl.[6] ..... B67B 5/00; B67D 5/40

[52] U.S. Cl. ..... 222/153.13; 222/384

[58] Field of Search ..... 222/153.13, 380, 222/384, 383.1

[56] References Cited

U.S. PATENT DOCUMENTS

| | | | |
|---|---|---|---|
| 4,819,835 | 4/1989 | Tasaki | 222/383.1 |
| 4,946,074 | 8/1990 | Grogan | 222/384 X |
| 4,971,252 | 11/1990 | Tasaki et al. . | |
| 5,114,049 | 5/1992 | Knickerbocker | 222/384 X |
| 5,207,359 | 5/1993 | Steijns | 222/384 X |
| 5,464,130 | 11/1995 | Tasaki | 222/383.1 |
| 5,560,545 | 10/1996 | Grogan et al. | 222/153.13 |
| 5,711,460 | 1/1998 | Saito et al. | 222/383.1 X |
| 5,823,395 | 10/1998 | Foster et al. | 222/153.13 X |
| 5,823,396 | 10/1998 | Vollmerhaus et al. | 222/153.13 |

FOREIGN PATENT DOCUMENTS

| | | |
|---|---|---|
| A-4-284873 | 10/1992 | Japan . |
| A-9-299838 | 11/1997 | Japan . |

*Primary Examiner*—Kevin P. Shaver
*Attorney, Agent, or Firm*—Oliff & Berridge, PLC

[57] ABSTRACT

A trigger-type liquid dispenser comprises a mounting sleeve (2) to be fitted onto a neck portion of a container body, a vertical sleeve (2*a*) erected from the mounting sleeve (2), an ejecting sleeve (3) projected forwardly from an upper end portion of the vertical sleeve (2*a*), a cylinder (4) projected forwardly from a middle portion of the vertical sleeve (2*a*), a plunger (6) slidably engaged in the cylinder (4) and being urged forwardly, a trigger (5) swingably attached to a front portion of the ejecting sleeve (3), a rear surface of an upper portion of the trigger (5) being engaged with an front end portion of the plunger (6), a nozzle fitting sleeve (7) fitted to a front end portion of the ejecting sleeve (3), and a nozzle head (8) rotatably fitted to an outer surface of the nozzle fitting sleeve (7), said nozzle head (8) being formed with a nozzle hole (10). Liquid stored in the container body is sucked up and ejected through the nozzle hole (10) by pulling the trigger (5) rearwardly. An arm (21) is projected rearwardly from an outer surface of the nozzle head (8). A first engaging portion (23) is provided at an upper portion of the trigger (5). A second engaging portion (26) is provided at a front surface of a lower portion of the cylinder (4). When the trigger (5) is positioned at its front-most position and the nozzle head (8) is rotated, a part of the arm (21) is detachably engaged with the first engaging portion (23), another part of the arm (21) is detachably engaged with the second engaging portion (26), so that the plunger (6) can not move rearwardly even if a user attempts to pull the trigger (5).

5 Claims, 7 Drawing Sheets

PUMP DISPENSER WITH ROTATABLE NOZZLE TRIGGER LOCK

BACKGROUND OF THE INVENTION

The present invention relates to a trigger-type liquid dispenser.

A conventional trigger-type liquid dispenser 1 shown in FIG. 12 comprises a mounting sleeve 2, a vertical sleeve 2*a*, an ejecting sleeve 3, a cylinder 4, a trigger 5, a plunger 6, a nozzle fitting sleeve 7 and a nozzle head 8. The vertical sleeve 2*a* is erected from an upper portion of the mounting sleeve 2 to be fitted onto an outer surface of a neck portion of a container body (not shown in FIG. 12). The ejecting sleeve 3 is projected forwardly from an upper end of said vertical sleeve 2*a*. The trigger 5 is swingably attached to a front portion 30 of said ejecting sleeve 3. The cylinder 4 is projected forwardly from said vertical sleeve 2*a*. The plunger 6 is arranged in a cylinder 4 and urged forwardly. A front end of the plunger 6 is engaged with a rear surface of an upper portion of said trigger 5. The nozzle head 8 is fitted into a front end of the ejecting sleeve 3 via the nozzle fitting sleeve 7. The nozzle head 8 has a nozzle hole 10. Liquid stored in the cylinder 4 is ejected through the nozzle hole 10 of the nozzle head 8 by pulling the trigger 5. When the trigger 5 is released, the plunger 6 is moved or returned forwardly, thereby returning the trigger 5 to its initial position, so as to suck up the liquid within the container body into the cylinder 4. Numeral 27 designates a cover plate which blocks the front surface of the nozzle head 8 openably.

In said trigger-type liquid dispenser, since liquid is ejected even if the trigger 5 is pulled inadvertently, a liquid discharge passage 11 in the nozzle head 8 and the nozzle fitting sleeve 7 fitted into the front end of the ejecting sleeve 3 is divided into a front portion 11*b* and a rear portion 11*a*. When the nozzle head 8 is rotated relative to the nozzle fitting sleeve 7, the nozzle head, the communication of said liquid discharge passage 11 is shut off. Liquid can be ejected only when the nozzle head is returned to its initial position.

Even if the liquid discharge passage is closed or shut by rotating the nozzle head 8 relative to the nozzle fitting sleeve 7, when the trigger 5 is pulled many times, the plunger 6 moves forwardly or backwardly a little due to the deflection or elastic restoration. Thus, high pressure liquid may accumulate in the front portion of the ejecting sleeve 3 between said discharge nozzle and the liquid discharge passage formed by said nozzle fitting sleeve 7 due to the abnormal high pressure in the cylinder. In this condition, when said nozzle head 8 is rotated to open the liquid discharge passage, high pressure liquid accumulated in the front portion of the ejecting sleeve 3 may happen to be discharged through the nozzle hole without operating the trigger 5. There is also the danger that the nozzle head 8 may be disconnected due to high pressure in the ejecting sleeve 3 when the trigger 5 is pulled strongly.

SUMMARY OF THE INVENTION

The present invention solves the above-described defects by The present invention provides a trigger-type liquid dispenser comprising;

a mounting sleeve (2) to be fitted onto a neck portion of a container body, a vertical sleeve (2*a*) erected from the mounting sleeve (2), an ejecting sleeve (3) projected forwardly from an upper end portion of the vertical sleeve (2*a*), a cylinder (4) projected forwardly from a middle portion of the vertical sleeve (2*a*), a plunger (6) slidably engaged in the cylinder (4), said plunger (6) being urged forwardly, a trigger (5) swingably attached to a front portion of the ejecting sleeve (3), a rear surface of an upper portion of the trigger (5) being engaged with an front end portion of the plunger (6), a nozzle fitting sleeve (7) fitted to a front end portion of the ejecting sleeve (3), and a nozzle head (8) rotatably fitted to an outer surface of the nozzle fitting sleeve (7), said nozzle head (8) being formed with a nozzle hole (10), wherein liquid stored in the container body is sucked up and ejected through the nozzle hole (10) by pulling the trigger (5) rearwardly, characterized in that an arm (21) is projected rearwardly from an outer surface of the nozzle head (8), a first engaging portion (23) is provided at an upper portion of the trigger (5), a second engaging portion (26) is provided at a front surface of a lower portion of the cylinder (4), and when the trigger (5) is positioned at its front-most position and the nozzle head (8) is rotated, a part of the arm (21) is detachably engaged with the first engaging portion (23), another part of the arm (21) is detachably engaged with the second engaging portion (26), so that the plunger (6) can not move rearwardly even if a user attempts to pull the trigger (5).

A surrounding sleeve (29) may be unrotatably engaged with an outer surface of the nozzle head (8), and an arm (21) is rearwardly projected from the surrounding sleeve (29). In other words, the arm 21 may be indirectly projected rearwardly from an outer surface of the nozzle head (8).

The second aspect of the invention provides a trigger-type liquid dispenser, wherein an engaging plate (24) is formed on and projected from a side surface of an upper portion of the trigger (5), the engaging plate (24) is formed with a through-hole which is bored perpendicularly and acts as the first engaging portion (23), a first engaging projection piece (22) is formed and projected from a middle portion of the arm (21), and the first engaging projection piece (22) is engagable with the through-hole of the engaging plate (24).

In this case, the trigger-type liquid dispenser may have a body cover 25 which has the front end surface. The front end surface acts as a second engaging portion 26.

The third aspect of the invention provides a trigger-type liquid dispenser, wherein a rear surface of an upper portion of the trigger (5) acts as the first engaging portion (23), a front surface of a lower portion of the cylinder (4) acts as the second engaging portion (26), a second engaging projection piece (28) is projected sideward and outward from a rear portion of the arm (21), and the second engaging projection piece (28) is positioned or engaged between the first engaging portion (23) and the second engaging portion (26).

PREFERRED EMBODIMENT OF THE INVENTION

Figure 11:
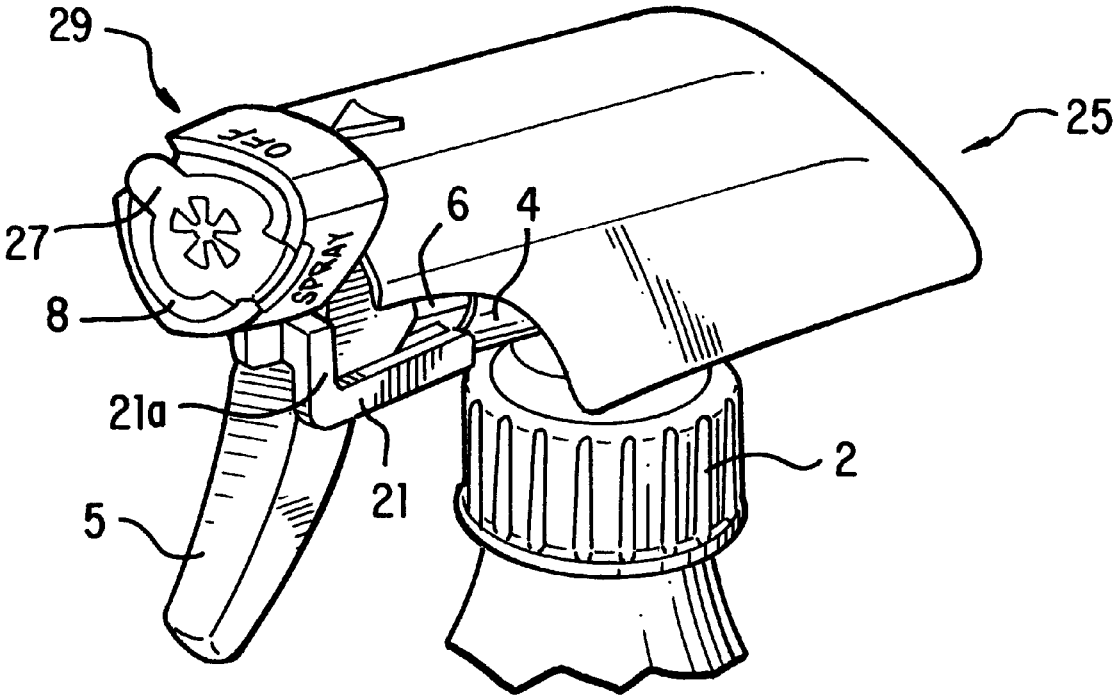
FIG. 11 is a perspective view of the liquid dispenser of FIG. 10.
Figure 12:
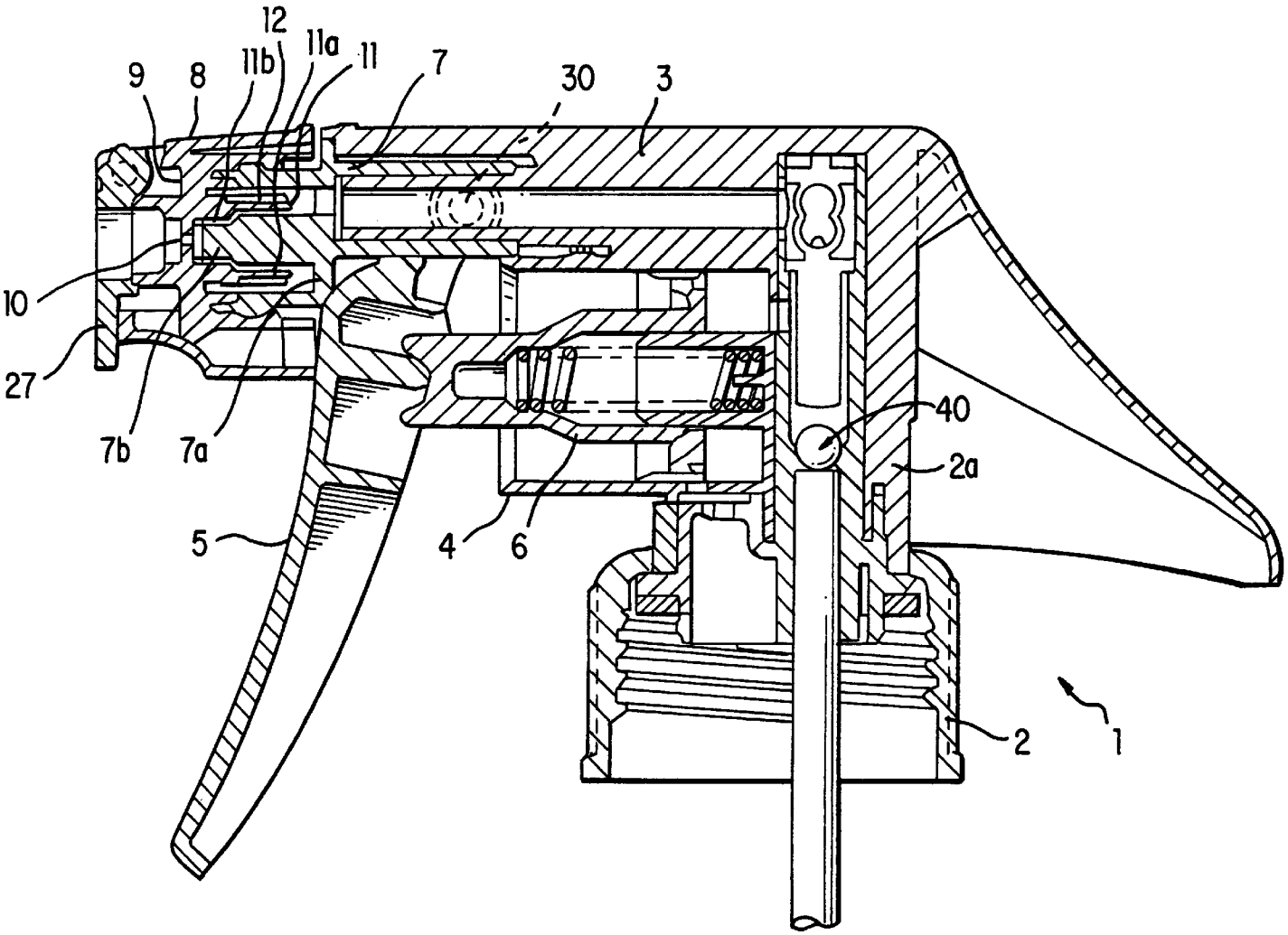
FIG. 12 is a sectional view of a conventional liquid dispenser.

Numeral 1 designates a generally used trigger-type liquid dispenser, which is described in conjunction with FIG. 12. The trigger-type liquid dispenser 1 shown in FIG. 12 comprises a mounting sleeve 2, a vertical sleeve 2*a*, an ejecting sleeve 3, a cylinder 4, a trigger 5, a plunger 6, a nozzle fitting sleeve 7 and a nozzle head 8. The vertical sleeve 2*a* is erected from an upper portion of the mounting sleeve 2 to be screwed onto an outer surface of a neck portion of a container body (partially illustrated in FIGS. 1–11). The ejecting sleeve 3 is projected forwardly from the upper end of said vertical sleeve 2*a*. The cylinder 4 is projected forwardly from the front surface of the middle portion of the vertical sleeve 2*a*. The trigger 5 is swingably attached to the front portion 30 of said ejecting sleeve 3 at the upper end portion thereof, and is depended obliquely downwardly and forwardly. The plunger 6 is arranged in the cylinder 4 and is urged forwardly. The front end of the plunger 6 is engaged with the back surface of the upper portion of the trigger 5. Liquid within the cylinder 4 is ejected through the ejecting sleeve 3 by pulling said trigger 5. When the trigger is returned, liquid within the container body is sucked into the cylinder 4 due to negative pressure in the cylinder 4 produced by the return of the trigger 5.

The nozzle head 8 is fitted to the front portion of said ejecting sleeve 3 via the nozzle fitting sleeve 7. The nozzle head 8 and the nozzle fitting sleeve 7 are provided with a liquid discharge passage 11 which communicates the ejecting sleeve 3 with a nozzle hole 10 bored in the center of a front wall 9 of the nozzle head 8. The nozzle fitting sleeve 7 has a base plate 7*a* and a valve rod 7*b* projecting from the central portion of the base plate 7*a*. The nozzle head 8 has the front wall 9 as described above, and has a fitting sleeve 12 projected backwardly from the center of the front wall 9. The fitting sleeve 12 is fitted onto an outer surface of the valve rod 7*b* water-tightly. As illustrated, said liquid discharge passage 11 is formed in the outer surface of the valve rod 7*b* and in the inner surface of the fitting sleeve 12. That is, said liquid discharge passage 11 comprises a first discharge passage 11*a* formed longitudinally (in the axial direction of the sleeve) in the inner surface of the rear portion of the fitting sleeve 12 and a second discharge passage 11*b* formed in the generatrix direction in the outer surface of the front portion of the valve rod 7*b*. When the nozzle head 8 is rotated relative to the nozzle fitting sleeve 7 from the communicated condition illustrated in FIG. 12, the first discharge passage 11*a* is displaced to a different position of the valve rod so that the communication with the second discharge passage 11*b* is shut off. When the nozzle head 8 is returned to its initial position, the communication is restored again as illustrated in FIG. 12. The above-described construction of the present invention is publicly known and is same as that of FIG. 12.

In the following, the present invention will be described in detail.

In the first embodiment illustrated in FIG. 1 to FIG. 5, an arm 21 is formed and projected directly from an outer surface of the nozzle head 8. A first engaging projection piece 22 is projected from the middle portion of the arm 21 in a direction of circumference of the nozzle head 8. An engaging plate 24 is formed and projected from the side surface of the upper portion of the trigger 5. The engaging plate 24 is formed with a through-hole which is bored perpendicularly and corresponds to a locus that the first engaging projection piece 22 rotates around an axis of the nozzle head 8. The through-hole acts as a first engaging portion 23. In the illustrated embodiment, the trigger-type liquid dispenser has a body cover 25 which covers the vertical sleeve 2*a*, the ejecting sleeve 3 and the cylinder 4, and which has the front end surface. The front end surface acts as a second engaging portion 26. The second engaging portion 26 may be formed in the front surface of the cylinder 4. When the nozzle head 8 is rotated so that the first engaging projection piece 22 is inserted into and engaged with the first engaging portion 23, and the rear end surface of the arm 21 is engaged with the second engaging portion 26 of the body cover 25. Thus, even if the user attempts to pull the trigger 5 under such condition, the trigger 5 can not move.

Figure 1:
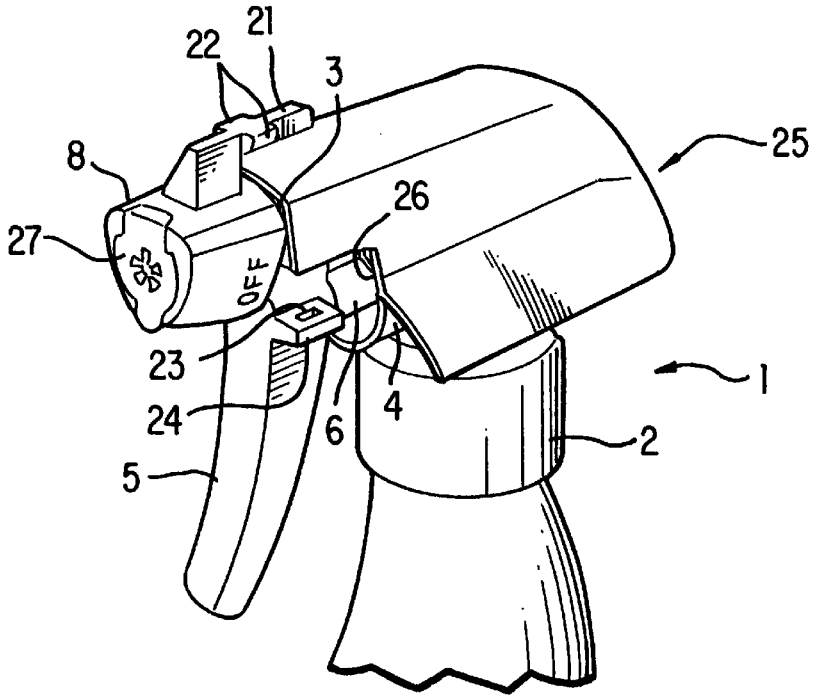
FIG. 1 is a perspective view of the liquid dispenser according to the first embodiment of the present invention.
Figure 2:
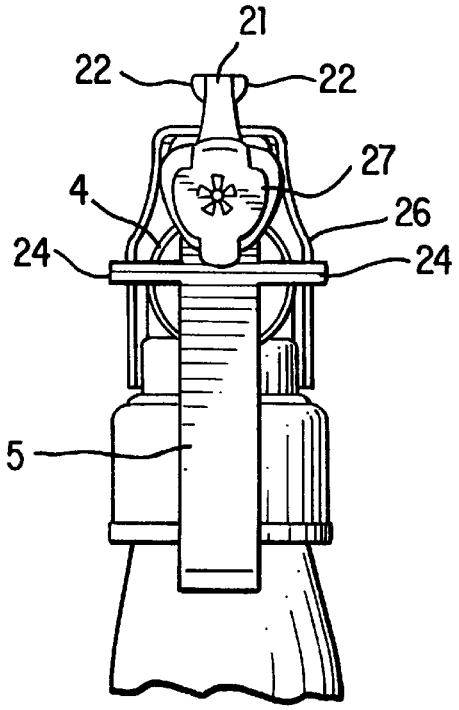
FIG. 2 is a front view of the liquid dispenser of FIG. 1.
Figure 3:
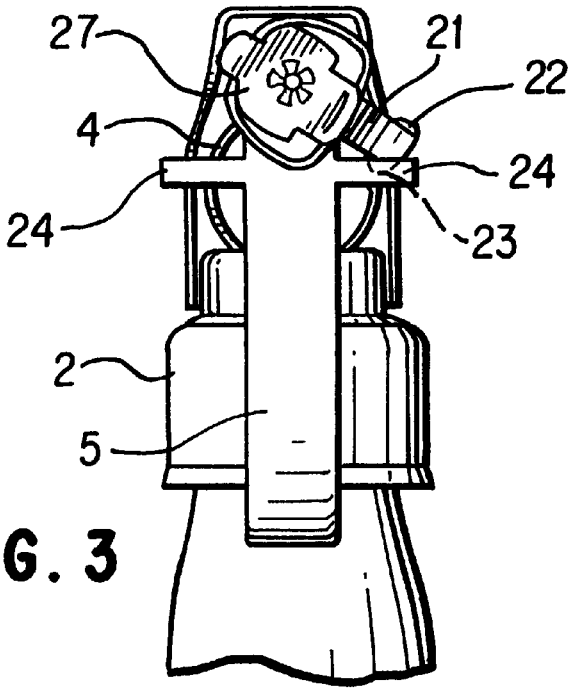
FIG. 3 is a front view of the liquid dispenser of FIG. 1, illustrating the locking state.
Figure 4:
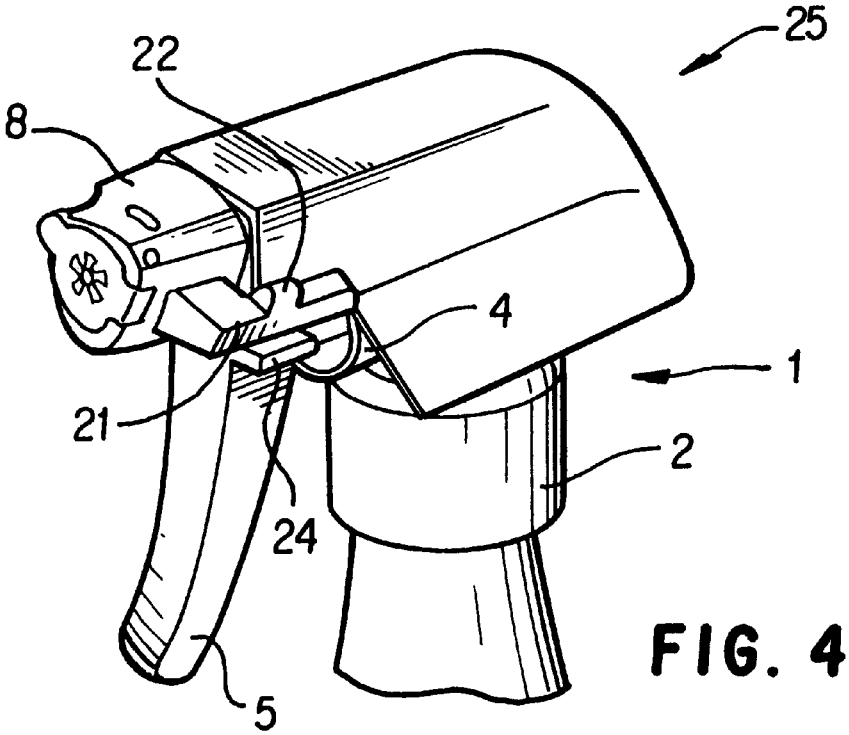
FIG. 4 is a perspective view of the liquid dispenser of FIG. 3.
Figure 5:
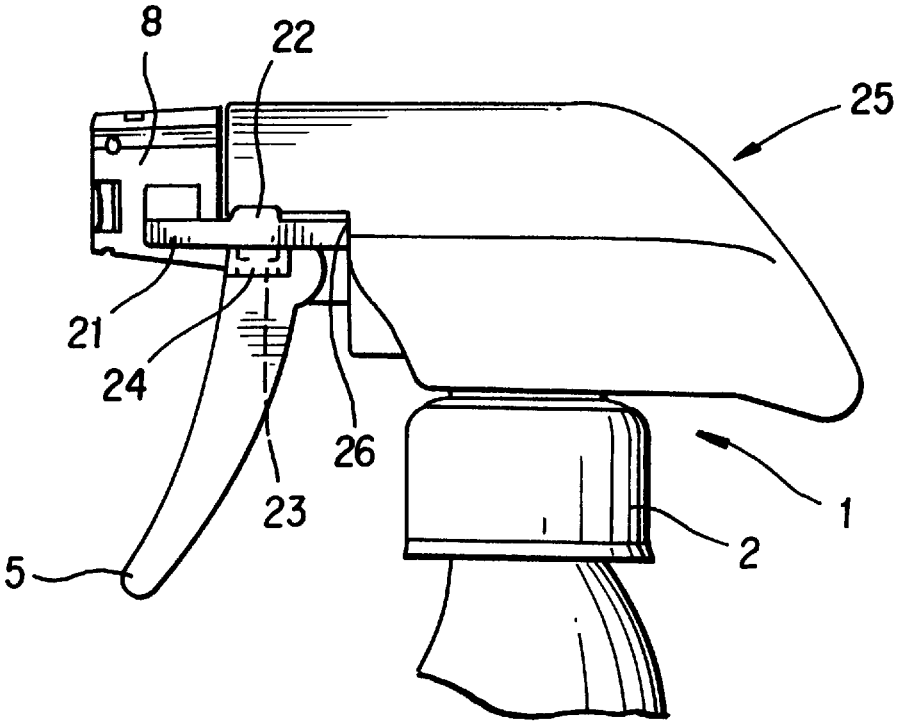
FIG. 5 is a side view of the liquid dispenser of FIG. 3.
Figure 6:
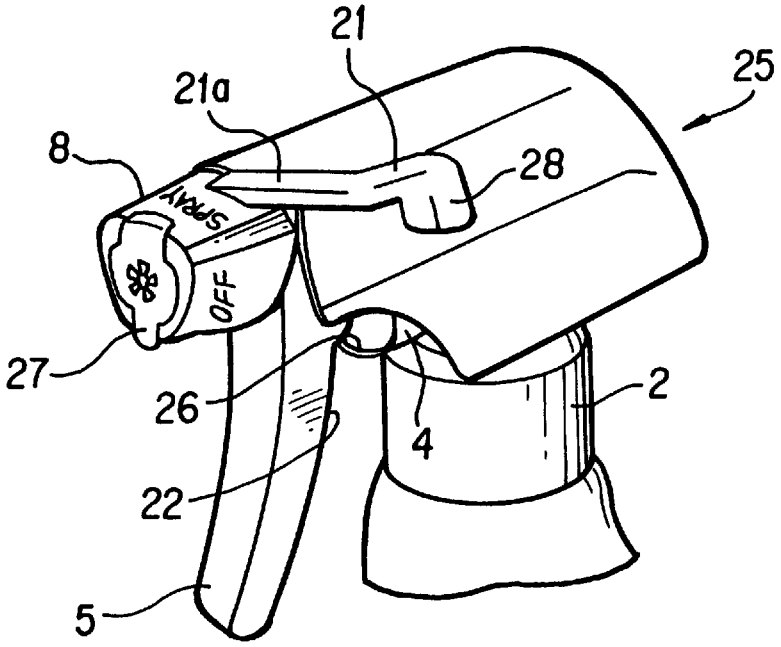
FIG. 6 is a perspective view of the liquid dispenser according to the second embodiment of the present invention.

In the illustrated example, two first engaging projection pieces 22, 22 are projected from left and right of the middle portion of the arm 21, and two engaging plates 24 with through-holes are projected from left and right of the upper portion of the trigger 5. However, only one first engaging projection piece 22 and only one engaging plate 24 may be provided, in other words, the present invention is not limited to two first engaging projection pieces and two engaging plates. When the arm 21 is positioned on the upper side of the nozzle head 8 as illustrated in FIG. 1, the first and the second liquid discharge passages 11*a* and 11*b* are communicated with each other as illustrated in FIG. 12, and liquid can be ejected or dispensed by erecting a cover plate 27 and pulling the trigger 5. When the nozzle head 8 is rotated so that the first engaging projection piece 22 of the arm 21 is engaged into the through-hole of the first engaging portion 23 and the rear end surface of the arm 21 is engaged with the second engaging portion 26 formed on the front surface of the body cover 25, the communication between the first and the second liquid discharge passages 11*a* and 11*b* is shut off.

Figure 7:
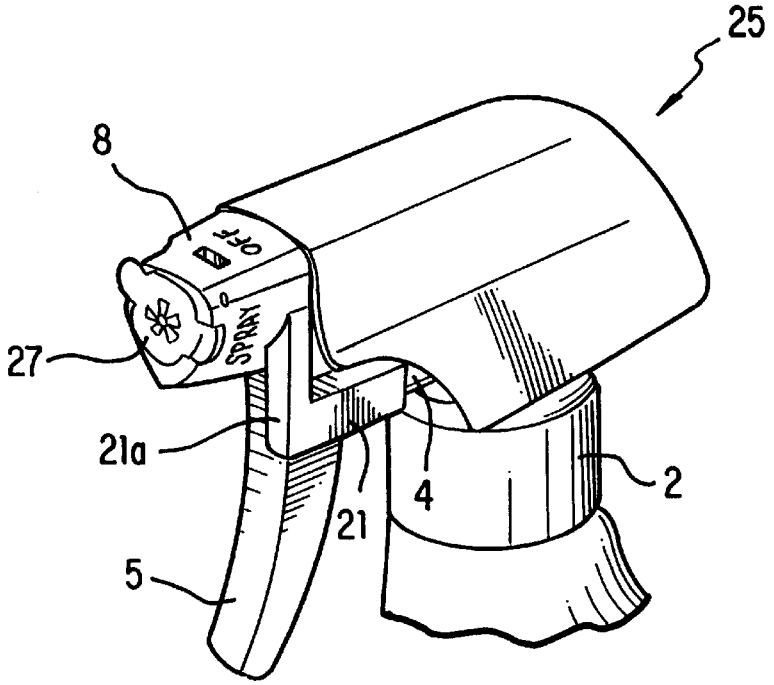
FIG. 7 is a perspective view of the liquid dispenser of FIG. 6, illustrating the locking state.
Figure 8:
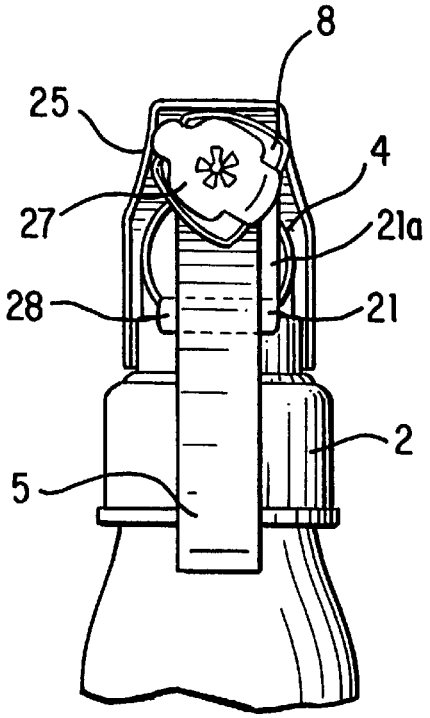
FIG. 8 is a front view of the liquid dispenser of FIG. 7.
Figure 9:
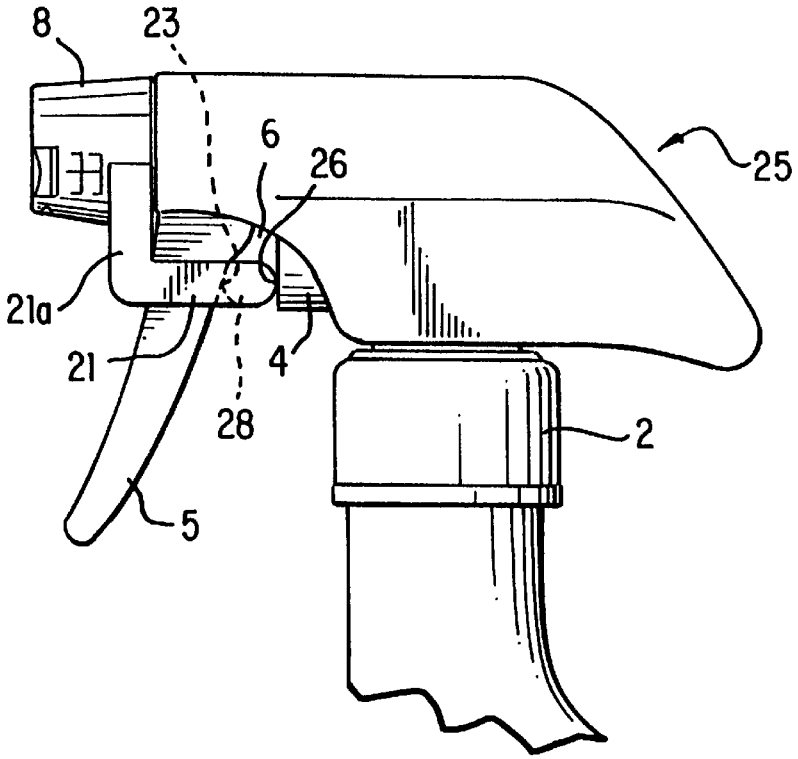
FIG. 9 is a side view of the liquid dispenser of FIG. 7.

In the second embodiment illustrated in FIG. 6 to FIG. 9, an arm 21 is projected backwardly via a sideward overhang 21*a*, and a second engaging projection piece 28 is projected sidewardly and outwardly from the rear portion of said arm 21. The rear surface of the upper portion of the trigger 5 acts as a first engaging portion 23. The front surface of the lower portion of cylinder 4 acts as a second engaging portion 26. When the nozzle head 8 is rotated as illustrated in FIGS. 7, 8 and 9, the second engaging projection piece 28 is positioned between the first engaging portion 23 and the second engaging portion 26 and engaged with them. Thus, even if the user attempts to pull the trigger 5 under such condition, the trigger 5 can not move so that the plunger 6 can not move backwardly, and the first and second liquid discharge passages 11*a* and 11*b* are shut off.

Figure 10:
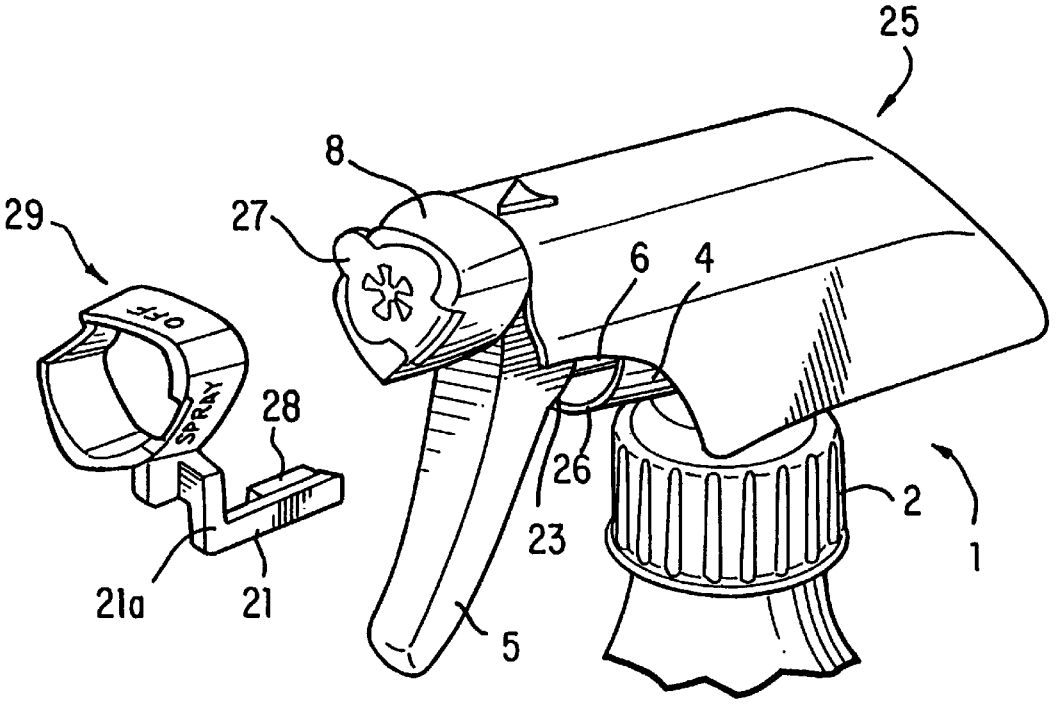
FIG. 10 is a partially exploded perspective view of the liquid dispenser according to the third embodiment of the present invention.

In the third embodiment illustrated in FIG. 10 and FIG. 11, a surrounding sleeve 29 is unrotatably engaged with the outer surface of the nozzle head 8. An arm 21 is projected backwardly via an overhang 21*a*. Also, a second engaging projection piece 28 is projected from the end portion of the arm 21. When the nozzle of head 8 is rotated, the second engaging projection piece 28 is positioned between the first engaging portion 22 (the rear surface of the upper portion of the trigger 5) and the second engaging portion 26 (the front surface of the lower portion of cylinder 4) and engaged with them, and the first and second liquid discharge passages 11*a* and 11*b* do not communicate each other. When the nozzle head 8 is further rotated with the surrounding sleeve 29 so as to further move the arm 21, the first and second liquid discharge passages 11*a* and 11*b* communicate each other like the condition illustrated in FIG. 12.

In the first embodiment as described above, the arm 21 is projected directly from the nozzle head 8. However, in the first embodiment, the arm 21 may be projected indirectly like the third embodiment. In other words, in the first embodiment, the nozzle head 8 may be unrotatably fitted with the surrounding sleeve 29 which has the arm 21. The third embodiment can be recognized as a modification of the second embodiment in which the arm 21 is indirectly projected.

The above described explanation relates to the trigger-type liquid dispenser having an open and shut (close) mechanism of the liquid discharge passage 11 (11*a* and 11*b*). However, if the trigger locking mechanism (the arm 21) as described above is provided, such open and shut mechanism is not necessary, because the liquid is not dispensed by the arm 21.

Since the first aspect of the present invention provides a trigger-type liquid dispenser as described above, there is no danger that the trigger is deflected so that the plunger is thereby retracted when the user attempts to pull the trigger, as in said conventional example, and therefore, liquid leakage and the like can be perfectly prevented.

According to the second aspect of the present invention as described above, the engagement and disengagement of the first engaging projection piece 22 with the first engaging portion 23 and the rear surface of the arm with the second engaging portion 26 can be easily carried out.

According to the third aspect of the present invention as described above, it is merely necessary to insert the second engaging projection piece 28 between the back surface of the upper portion of the trigger 5 and the front surface of the lower portion of the cylinder 4, and the construction thereof can be thereby simple, and the attachment and detachment operations can be easily carried out.

What is claimed is:

1. A trigger-type liquid dispenser comprising a mounting sleeve (2) to be fitted onto a neck portion of a container body, a vertical sleeve (2*a*) erected from the mounting sleeve (2), an ejecting sleeve (3) projected forwardly from an upper end portion of the vertical sleeve (2*a*), a cylinder (4) projected forwardly from a middle portion of the vertical sleeve (2*a*), a plunger (6) slidably engaged in the cylinder (4), said plunger (6) being urged forwardly, a trigger (5) swingably attached to a front portion of the ejecting sleeve (3), a rear surface of an upper portion of the trigger (5) being engaged with an front end portion of the plunger (6), a nozzle fitting sleeve (7) fitted to a front end portion of the ejecting sleeve (3), and a nozzle head (8) rotatably fitted to an outer surface of the nozzle fitting sleeve (7), said nozzle head (8) being formed with a nozzle hole (10), wherein liquid stored in the container body is sucked up and ejected through the nozzle hole (10) by pulling the trigger (5) rearwardly, characterized in that an arm (21) is projected rearwardly from an outer surface of the nozzle head (8), a first engaging portion (23) is provided at an upper portion of the trigger (5), a second engaging, portion (26) is provided at a front surface forward of the mounting sleeve (2), and when the trigger (5) is positioned at its front-most position and the nozzle head (8) is rotated, a part of the arm (21) is detachably engaged with the first engaging portion (23), another part of the arm (21) is detachably engaged with the second engaging portion (26), so that the plunger (6) can not move rearwardly even if a user attempts to pull the trigger (5).

2. The trigger-type liquid dispenser according to the claim 1, wherein a surrounding sleeve (29) is unrotatably engaged with an outer surface of the nozzle head (8), and said arm (21) is rearwardly projected from the surrounding sleeve (29).

3. The trigger-type liquid dispenser according to the claim 1, wherein an engaging plate (24) is formed on and projected from a side surface of the upper portion of the trigger (5), the engaging plate (24) is formed with a through-hole which is bored perpendicularly and acts as the first engaging portion (23), said part comprises a first engaging projection piece (22) formed and projected from a middle portion of the arm (21), and the first engaging projection piece (22) is engagable with the through-hole of the engaging plate (24).

4. The trigger-type liquid dispenser according to the claim 1, wherein the trigger-type liquid dispenser has a body cover (25) which covers the vertical sleeve (2*a*), the ejecting sleeve (3) and the cylinder (4), a front surface of the body cover (25) acts as the second engaging portion (26).

5. The trigger-type liquid dispenser according to the claim 1, wherein a rear surface of the upper portion of the trigger (5) acts as the first engaging portion (23), a front surface of a lower portion of the cylinder (4) acts as the second engaging portion (26), a second engaging projection piece (28) is projected sideward and outward from a rear portion of the arm (21) and comprises the part and another part, and the second engaging projection piece (28) is positioned or engaged between the first engaging portion (23) and the second engaging portion (26).

* * * * *